US009777382B2

(12) United States Patent
Yoshinaga et al.

(10) Patent No.: US 9,777,382 B2
(45) Date of Patent: Oct. 3, 2017

(54) ELECTROCHEMICAL CELL, OXYGEN REDUCTION DEVICE USING THE CELL AND REFRIGERATOR USING THE OXYGEN REDUCTION DEVICE

(71) Applicant: Kabushiki Kaisha Toshiba, Minato-ku (JP)

(72) Inventors: Norihiro Yoshinaga, Kawasaki (JP); Hiroaki Hirazawa, Kawasaki (JP); Yoshihiro Akasaka, Kawasaki (JP); Katsuyuki Naito, Tokyo (JP); Taishi Fukazawa, Tokyo (JP); Jun Tamura, Yokohama (JP); Ryosuke Yagi, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 79 days.

(21) Appl. No.: 14/729,222

(22) Filed: Jun. 3, 2015

(65) Prior Publication Data

US 2016/0355934 A1 Dec. 8, 2016

(51) Int. Cl.

| | |
|---|---|
| ***C25B 9/08*** | (2006.01) |
| ***C25B 11/03*** | (2006.01) |
| ***F25D 17/04*** | (2006.01) |

(52) U.S. Cl.

CPC ..... *C25B 9/08* (2013.01); *C25B 11/035* (2013.01); *F25D 17/042* (2013.01)

(58) Field of Classification Search

CPC ..... C25B 11/035

See application file for complete search history.

(56) References Cited

U.S. PATENT DOCUMENTS 4,260,469 A * 4/1981 McIntyre ..... C25B 11/035 204/265
4,278,525 A * 7/1981 Gestaut ..... C25B 1/46 204/265

(Continued)

FOREIGN PATENT DOCUMENTS

JP 7-41980 2/1995
JP 09-287869 A * 11/1997

(Continued)

OTHER PUBLICATIONS

Derwent abstract of JP 09-287869 A.*

(Continued)

*Primary Examiner* — Harry D Wilkins, III
(74) *Attorney, Agent, or Firm* — Oblon, McClelland, Maier & Neustadt, L.L.P.

(57) ABSTRACT

According to one embodiment, an electrochemical cell includes an anode, a cathode and an electrolytic membrane interposed therebetween. At least one of the anode and the cathode is formed of an integral solid conductive plate and includes a first surface in contact with the electrolytic membrane and a second surface apart from the first surface in a thickness direction. The at least one of the anode and the cathode includes a plurality of first pores opened in the first surface and a plurality of second pores opened in the second surface, the second pores communicating with a part of the first pores. The first pores are smaller than the second pores, and the concentration of pores in the first surface is higher than that in the second surface.

11 Claims, 5 Drawing Sheets

(56) References Cited

U.S. PATENT DOCUMENTS

| | | | | |
|---|---|---|---|---|
| 4,496,437 | A * | 1/1985 | McIntyre | C25B 11/035 204/265 |
| 5,746,896 | A * | 5/1998 | Shimamune | C25B 11/03 204/290.14 |
| 5,873,988 | A * | 2/1999 | Schulze | C25B 11/04 204/284 |
| 6,117,286 | A * | 9/2000 | Shimamune | C25B 9/08 204/252 |
| 6,376,118 | B1 * | 4/2002 | Bruck | H01M 8/0228 429/514 |
| 6,682,843 | B2 | 1/2004 | Speranza et al. | |
| 7,611,611 | B2 | 11/2009 | Belt | |
| 2001/0008722 | A1 | 7/2001 | Speranza et al. | |
| 2002/0020623 | A1 * | 2/2002 | Speranza | C25B 15/02 204/228.5 |
| 2003/0047459 | A1 * | 3/2003 | Timonov | C25B 1/13 205/170 |
| 2005/0106450 | A1 * | 5/2005 | Castro | C25B 11/035 429/480 |
| 2005/0250003 | A1 * | 11/2005 | Zagaja | C25B 1/10 204/242 |
| 2006/0042935 | A1 | 3/2006 | Houda et al. | |
| 2006/0144709 | A1 | 7/2006 | Belt | |
| 2009/0242391 | A1 * | 10/2009 | Darvas | C02F 1/46109 204/252 |
| 2012/0052402 | A1 * | 3/2012 | Turek | C25B 11/035 429/405 |
| 2013/0236797 | A1 * | 9/2013 | Bulan | C25B 11/035 429/405 |

FOREIGN PATENT DOCUMENTS

| | | |
|---|---|---|
| JP | 11-24119 | 1/1999 |
| JP | 2002-533577 | 10/2002 |
| JP | 2005-536639 | 12/2005 |
| JP | 2006-63419 | 3/2006 |
| JP | 2006-176835 | 7/2006 |
| JP | 2009-209379 | 9/2009 |
| JP | 4453973 | 4/2010 |
| JP | 2010-189709 A | 9/2010 |
| JP | 2014-101549 | 6/2014 |
| WO | WO 2004/048643 A1 | 6/2004 |

OTHER PUBLICATIONS

Machine translation of JP 2010-189709 A.*

Office Action issued Jul. 12, 2016 in Japanese Patent Application No. 2012-254578 (with unedited computer generated English language translation).

* cited by examiner

ELECTROCHEMICAL CELL, OXYGEN REDUCTION DEVICE USING THE CELL AND REFRIGERATOR USING THE OXYGEN REDUCTION DEVICE

CROSS-REFERENCE TO RELATED APPLICATIONS

This application is based upon the prior Japanese Patent Application No. 2012-254578 filed Nov. 20, 2012, the entire contents of which are incorporated herein by reference.

FIELD

Embodiments described herein relate generally to an electrochemical cell used for, for example, an electrolytic cell for electrolysis, an oxygen reduction device using the cell and a refrigerator using the oxygen reduction device.

BACKGROUND

Conventionally, conductive porous materials processed by expanding, etching, or punching are used as an electrode and electrode base material which are used for an electrolytic cell, a cell, etc.

For example, as the base material of an anode of an electrochemical cell used to produce sodium hydroxide, a catalyst-coated titanium mesh in which a titanium plate of a mesh structure is coated with a catalyst, is used.

The titanium plate of mesh structure functions not only as a carrier of a catalyst, but also a diffusion path for a material to be reacted, such as a gas, and a feeding member.

The reaction formulas involved in the production of sodium hydroxide manufacture are as follows.

Reaction at cathode $2H_2O+2e^- \rightarrow H_2+2OH$

Reaction at anode $2Cl^- \rightarrow Cl_2+2e^-$

Overall reaction $2H_2O+2NaCl \rightarrow 2NaOH+Cl_2+H_2$

The reason for using titanium as a base material of the anode in the production of sodium hydroxide manufacture is because the anode potential becomes very high. When stainless steel, copper, nickel or the like is used as the base material of the anode and the anode potential becomes high, an elution may occur.

When selecting a base material in terms of properties, it is desirable to select one which does not elute easily if the electrode is exposed to an electrical potential involved in a desired reaction. For example, usable examples of the base material for the cathode, which can produce hydrogen in the above-provided reaction formula are stainless steel, copper and carbon in addition to titanium.

In the above-listed examples, porous materials are indicated as base materials, but it is also possible to use a material which has a catalytic effect by itself, such as Pt, Ni or Pd, as a porous material by processing the material into a porous structure, as a porous electrode.

Here note that in the case where a great number of pores are to be opened in a base material of a conductive plate having a certain thickness by a method applicable to mass-production, such expanding, etching or punching, as the thickness of the base material is less, it becomes possible to process the material to have smaller pores in diameter by the method. Generally, it is more difficult to shorten the distance between openings than to make the base material thin due to the processability (workability). Therefore, in the case where pores should be opened as many as possible per unit area (the concentration of pores should be increased), the thinner the base material, the more advantageous because the distance between openings is smaller in thinner base materials.

Electrodes which employ a base material of such a porous structure are used for, for example, electrodes of zero-gap electrochemical cells. In a zero-gap electrochemical cell, an electrode is disposed to tightly attach to the solid electrolytic membrane without any gap.

The electrochemical reaction in the electrochemical cell occurs in the interface between the electrolytic membrane through which ions can move and the catalyst.

As to the movement of materials subjected to reaction and products thereof, the shorter the distance between openings, the shorter the distance in which they move a narrow path made by the electrolytic membrane and the electrode tightly attached to each other. Here, since the diffusion resistance is suppressed more as the diffusion distance is shorter, the voltage applied to the electrochemical cell is decreased.

Moreover, the reaction area can be listed as another important factor for progress of a reaction in an electrochemical cell. A reaction area becomes larger, as the porosity of the electrode employing the base material of a porous structure is less. For this reason, it is more advantageous when the base material of the electrode is thinner because for the same porosity, the higher the concentration of pores, the higher the rate of reaction realizable.

It should be noted that, when the base material of an electrode is thin, the conduction path of the base material itself becomes narrow, and it is expected that the collector resistance increases. To avoid this, there has been such an attempt to join a collector plate and a feed plate to the electrode base material having a mesh structure, so as to lower the collector resistance.

However, if this structure allows electrolytic ions to enter the collector plate and feed plate, it is necessary to select, for the collector plate and feed plate, materials which do not elute with an electrical potential by which the reaction is occurring (to be called a reaction potential hereinafter) as in the case of the base material for the electrode.

Further, even the materials which do not elute at the reaction potential may increase the contact resistance with respect to the electrode, if the collector plate and feed plate are formed of a material with which an oxide layer is formed on its surface, such as titanium or aluminum. To avoid this, it is necessary to coat the surface of the material which forms the collector plate and feed plate with a corrosion resistance substance so that the material for the collector plate and feed plate is not oxidized as brought into direct contact with the electrode.

For example, the anode of an electrolytic cell configured to electrolyze water is exposed to a potential higher than 1.23VvsRHE. For this reason, it is required to use such an anode that the surface of titanium, which gives rise to a conductive plate or feed plate, with platinum (Pt), which does not easily elute at such an electrical potential, by sputtering or plating.

An object of the embodiments is to provide an electrochemical cell which can improve both the rate of reaction at an interface with an electrolytic membrane and the feeding performance, and does not easily corrode by the reaction potential by a simple structure, an oxygen reduction device using the cell, and a refrigerator using the oxygen reduction device.

DETAILED DESCRIPTION

Various embodiments will be described hereinafter with reference to the accompanying drawings. In general, according to one embodiment, an electrochemical cell comprises an anode, a cathode and an electrolytic membrane interposed therebetween. At least one of the anode and the cathode is formed of a solid conductive plate integrally formed and includes a first surface in contact with the electrolytic membrane and a second surface apart from the first surface in a thickness direction. The at least one of the anode and the cathode includes a plurality of first pores opened in the first surface and a plurality of second pores opened in the second surface, the second pores communicating with the first pores. The first pores are smaller than the second pores, and the concentration of pores in the first surface is higher than that in the second surface.

(First Embodiment)

Figure 5:
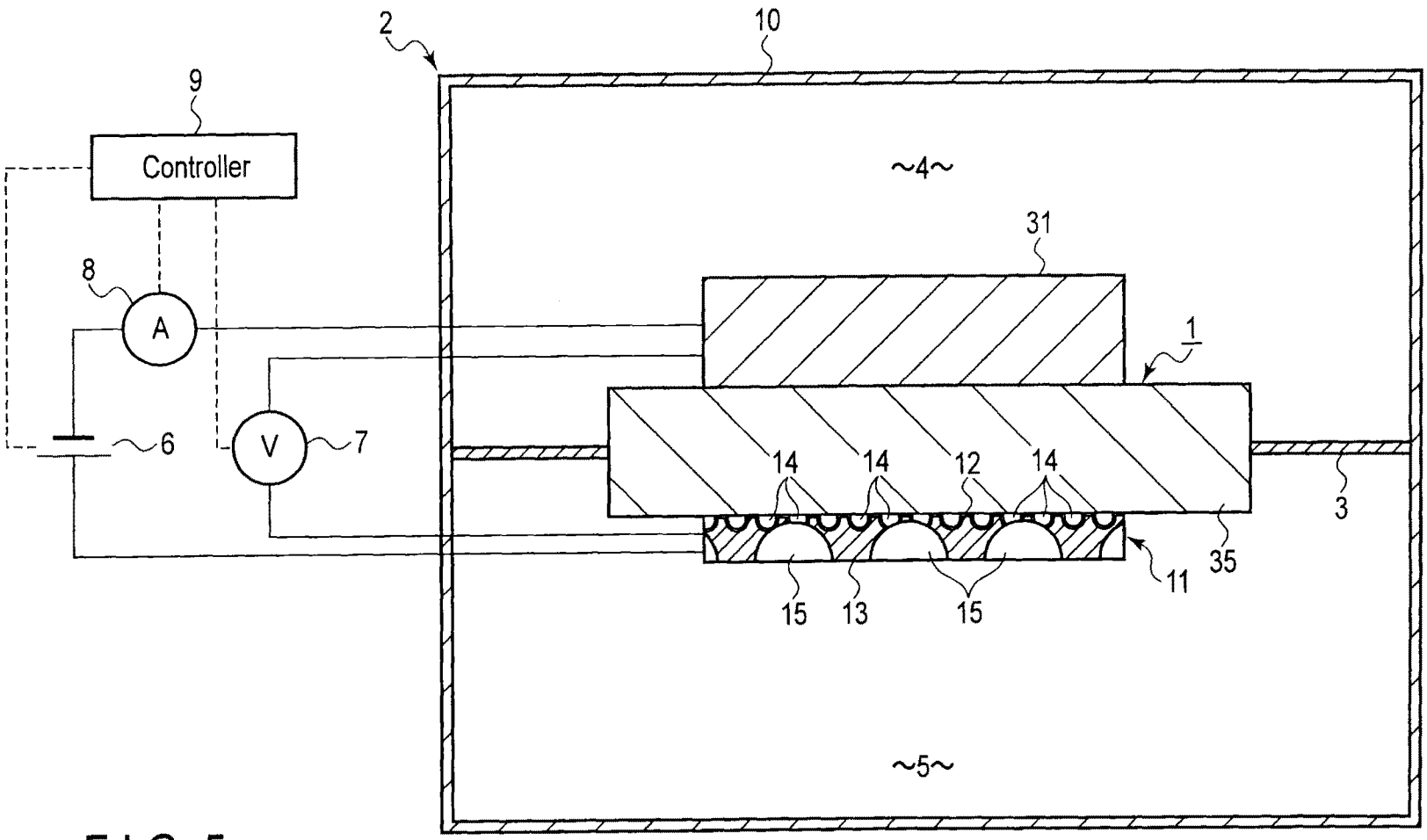
FIG. 5 is a sectional view schematically showing the structure of an electrochemical device employing the electrochemical cell of FIG. 1 as an electrolytic cell.

FIG. 5 is a sectional view briefly showing an electrochemical device employing an electrochemical cell according to a first embodiment as an electrolytic cell. As shown in this figure, the electrochemical device comprises an electrochemical cell 1 of first embodiment, and the electrochemical cell comprises an anode 11, a cathode 31 and an electrolytic membrane 35 interposed therebetween.

The anode 11 is a member configured as an electrode of the electrochemical cell 1, and functions, not only as a carrier of a catalyst, but also a diffusion path for materials subjected to reaction, such as gas, and a collector or a feeding member. The anode 11 may comprise an electrode base material (also referred to as an anode base material) and a catalytic layer 16 (FIG. 3) formed on an entire surface of the base material, or may comprise an electrode base material itself.

Figure 2:
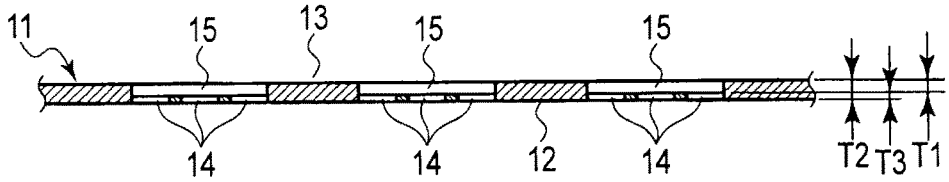
FIG. 2 is a sectional view briefly showing the anode taken along line F2-F2 in FIG. 1.
Figure 3:
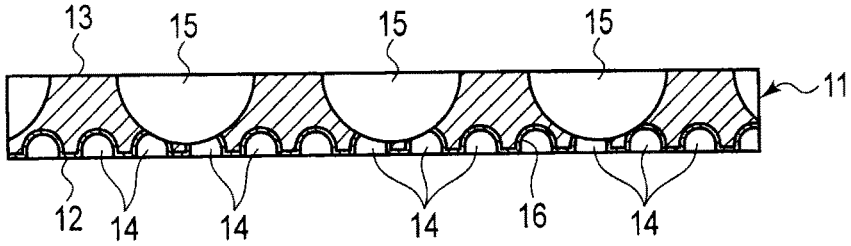
FIG. 3 is an enlarged sectional view showing a part of the anode shown in FIG. 1.

The electrode base material for the anode 11 is formed of a solid conductive plate. As shown in FIGS. 2 and 3, the anode 11 formed of the solid plate comprises a first surface 12 and a second surface 13. The first surface 12 is a surface which contacts the electrolytic membrane 35 and functions as a reaction side (electrolytic surface). The second surface 13 is a surface apart in the thickness direction from the first surface 12, and is, for example, parallel to the first surface 12. The second surface 13 that does not contact the electrolytic membrane 35 functions as a feeding side.

Examples of the element which forms the electrode base material which supports a catalytic layer (also referred to as an anode catalytic layer) of the anode 11 are metallic elements such as Ta, Ti, SUS, and nickel, or carbon. These elements can be properly used according to the reaction potential of the anode 11. The criteria for selecting such an element can be confirmed generally by a pH-potential diagram and the like. For example, in the case of the electrode base material of the anode used for production of sodium hydroxide, titanium (Ti) needs to be used because nickel and SUS elute and are not usable.

In the case where the electrode base material itself functions as a catalyst and has activity in the reaction, the anode 11 can be formed from the base material itself, in which case this electrode does not require a catalytic layer. An example of the element which forms such an electrode base material is platinum (Pt). Further, the anode 11 can also be used as an elution electrode, which exhausts with the reaction according to the operating condition of the electrochemical cell 1.

As shown in FIGS. 2 and 3, the anode 11 has a porous structure. That is, the anode 11 comprises a plurality of first pores 14 and a plurality of second pores 15, and the second pores communicate with some of the first pores 14. Each of the first pores 14 is opened in the first surface 12 and each of the second pores 15 is opened in the second surface 13.

As shown in FIG. 2, the thickness T3 of the portion of the anode 11 on the second surface 13 side in which the second pores 15 are formed, is greater than the thickness T2 of the portion of the anode 11 on the first surface 12 side in which the first pores 14 are formed. With this structure, the second pores 15 are formed more deeply in the thickness direction of the electrode base material than the first pores 14.

Further, as shown in FIG. 3, each of the second pores 15 is formed to narrow toward the first pores 14 side communicating therewith (in other words, as approaching the first surface 12) and widen toward the second surface 13 side (in other words, further from the first pores 14 side).

The anode 11 of the solid structure described above can be manufactured by subjecting a conductive electrode base material to, for example, wet etching using various types of etching solutions. In this case, the electrode base material of a solid plate may be etched one surface at a time, or both surfaces at the same time. The masking and etching methods are not particularly limited.

When the electrode base material should be etched one surface at a time, the etching is performed while one surface is covered with a masking member having a plurality of predetermined openings, whereas the other surface is entirely covered with a masking member. Further, when the electrode base material should be etched both surfaces at the same time, both surfaces are covered with respective masking members having a plurality of predetermined openings in the etching.

In addition, as to the type of etching, another example applicable to manufacture of the anode 11, besides wet etching, is photoetching. Note that the anode 11 can also be manufactured by processing by a laser, precision cutting or the like, besides etching.

The first pores 14 are formed smaller than the second pores 15. Further, the concentration of first pores 14 in the first surface 12 is higher than that of second pores 15 in the second surface 13.

Here, the number of the first pores 14 should preferably be 30 or more per square centimeter, and more preferably 200 or more per square centimeter. These values have been set based on the test results shown in FIG. 4.

Figure 1:
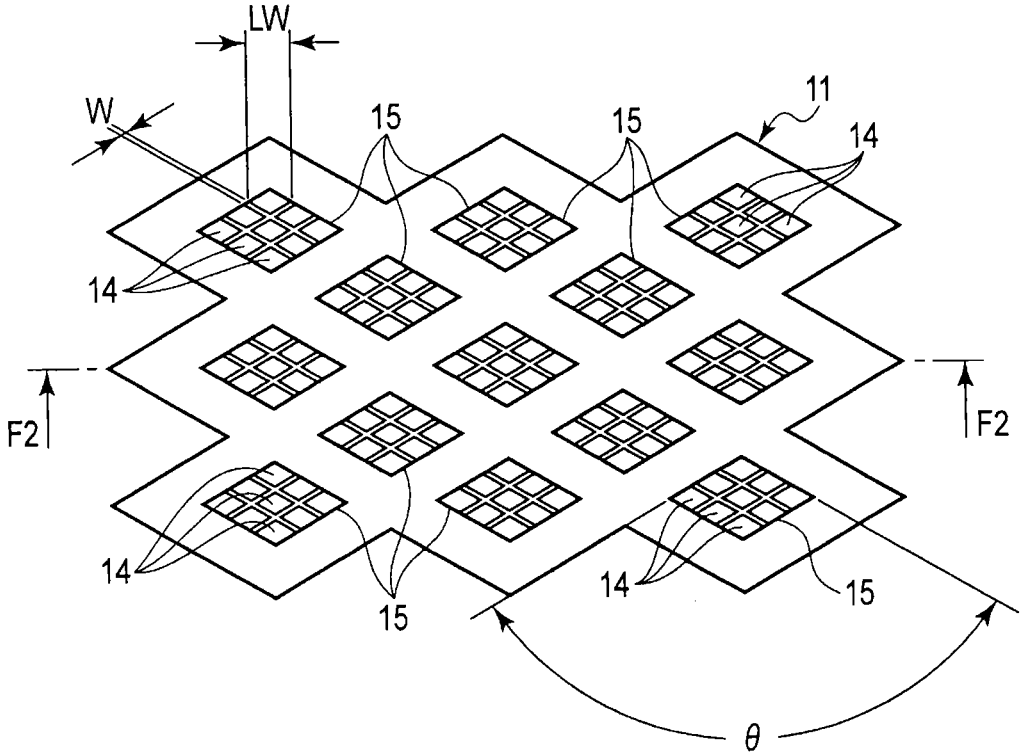
FIG. 1 is a perspective view briefly showing an anode used for an electrochemical cell according to a first embodiment.
Figure 4:
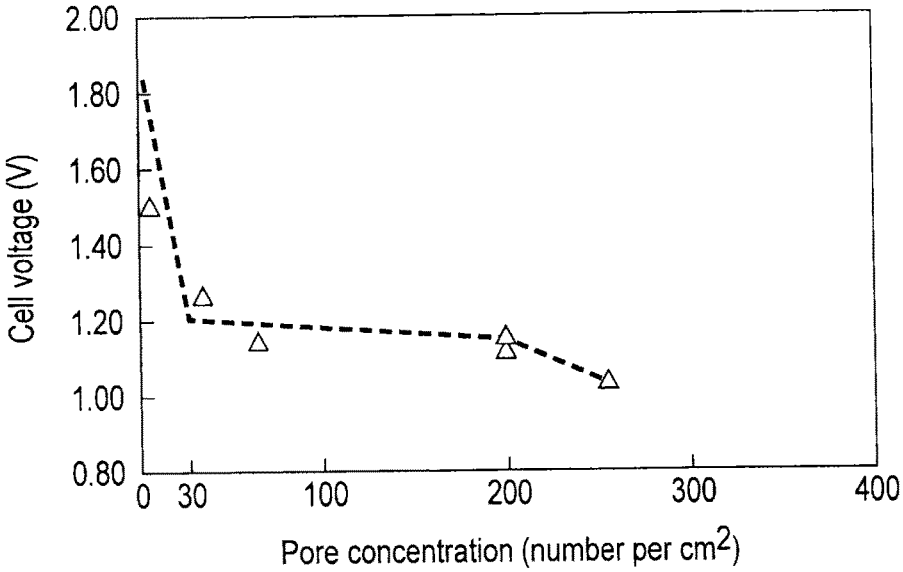
FIG. 4 is a graph indicating the relationship between the cell voltage and the concentration of pores in the first surface of the anode in the electrochemical cell according to the first embodiment.

FIG. 4 shows the results of measurement of the voltage created between an anode and a cathode of cells prepared as follows. In the measurement, samples which have the structure shown in FIGS. 1 and 2 with various numbers of the first pores 14 were prepared, and these samples were used as the anodes of the electrochemical cells to be tested. The results confirmed that the cell voltage increases abruptly when the concentration of first pores 14 is less than 30 per square centimeter. It was also confirmed that when the concentration of first pores 14 is 30 per square centimeter to less than 200 per square centimeter, the cell voltage tends to gradually decrease. It was furthermore confirmed that when the concentration of first pores 14 exceeds 200 square centimeter, the cell voltage tends to decrease abruptly as compared to the case where the concentration of pores is lower than this. Therefore, in order to control the cell voltage of the electrochemical cell 1 to 1.2V or less, it is preferable to set the porous ratio of the first pores 14 as described.

On the other hand, it suffices only if the number of the second pores 15 opened in the second surface 13 is adjusted according to the required collector performance or feeding performance, and it is set to, for example, 30 per square centimeter or less.

In the anode 11 comprising the catalytic layer 16, an anode catalytic layer (not shown) is formed on the first surface 12 of its electrode base material. Note that the material used for the catalytic layer 16 needs to be appropriately selected according to the reaction taking place in the anode 11.

For example, preferable examples of the material which forms the catalytic layer of the anode for fuel cells, in which production of electrolytic hydrogen, oxidation of hydrogen, oxidation of methanol, etc., are carried out are platinum-based catalysts including, for example PtCo, PtFe, PtNi, PtPd, PtIr, PtRu and PtSn. But, in addition, a metal catalyst, a nitrogen-substituted carbon catalyst, an oxide catalyst and the like can also be used.

As a material which forms the catalytic layer of the anode for brine electrolysis, or the anode for production of oxygen, metal catalysts such as platinum and palladium, a lead oxide, an iridium complex oxide, a ruthenium complex oxide, an oxide catalyst, etc., can be used. Examples of the production method of these catalysts are a pyrolysis method, a sol-gel process, a polymerized complex method and a sputtering method. As a composite metal which forms the above-described oxide, at least one of Ti, Nb, V, Cr, Mn, Co, Zn, Zr, Mo, Ta, W, Tl, Ru and Ir can be used.

The cathode 31, which makes the counter-electrode of the anode 11, is an electrode having a porous structure. For the cathode 31, stainless steel, copper, carbon or the like can be used, besides titanium.

The cathode 21 of the above-described structure can be used appropriately as an electrode for soda electrolysis or water splitting. Note that the use of the cathode is not limited to the above, but can be used as a general zero gap electrode.

The cathode 31, which is the counter-electrode to the anode 11, may comprise an electrode base material (also referred to as a cathode base material) and a catalytic layer (referred to as a cathode catalyst) formed on an entire surface of the base material, or may comprise an electrode base material itself.

As the element of the electrode base material which supports the catalytic layer of the cathode 31, metallic elements such as Ta, Ti, SUS and Ni, carbon or a gaseous diffusion layer (GDL) containing carbon can be used. An appropriate element should be selected from these according to the reaction potential of the cathode 31. As a catalyst for oxygen reduction/oxidation reaction used for fuel cells or oxygen reduction element, platinum-based catalysts including, for example PtCo, PtFe, PtNi, PtPd, PtIr, PtRu and PtSn can be used. But, in addition, a metal catalyst, a nitrogen-substituted carbon catalyst, an oxide catalyst and the like can also be used.

Further, as a cathode for brine electrolysis or a cathode for production of oxygen, silver, palladium, platinum, etc., are preferable, and in addition, a metal catalyst, a nitrogen-substituted carbon catalyst, an oxide catalyst, and also carbon can be used as well.

The catalytic layer of the cathode 31 can be formed by sputtering on an electrode base material, or by applying directly on the electrode base material a suspension in which catalyst powder is dispersed in water, an alcohol, or the like. Note that besides the application of catalysis onto an electrode base material, described above, when the base material itself functions as a catalyst and has activity in a reaction, the cathode 31 can be formed of this material itself. In this case, the electrode does not require a catalytic layer. An example of the element which forms such an electrode base material is platinum (Pt). Further, the anode 11 can also be used as an elution electrode, which exhausts with the reaction according to the operating condition of the electrochemical cell 1.

For the electrolytic membrane 35, a polymer electrolytic membrane such as a cation-exchange solid polymer electrolytic membrane, more specifically, a cation-exchange membrane or anion-exchange membrane, or a hydrocarbon-based film can be used.

Examples of the cation-exchange membrane are NAFION (registered trademark of E.I. du Pont de Nemours & Co.) 112, 115 or 117; Flemion (registered trademark of Asahi Glass Co., Ltd.); ACIPLEX (registered trademark of Asahi Chemical Co., Ltd.); and GOA SELECT (registered trademark of W.L. Gore and Associates Company). An example of the anion-exchange membrane is A201 of Tokuyama, Inc.

The electrochemical cell 1 of the above-described structure can be manufactured by subjecting the electrolytic membrane 35 to hot pressing while sandwiching the electrolytic membrane 35 with the anode 11 and the cathode 31, thereby joining the cathode 31 to the electrolytic and also the anode 11 to the membrane 35.

As shown in FIG. 5, an electrochemical device 2 comprising the electrochemical cell 1 as an electrolytic cell, comprises an electrolytic vessel 10. The inside of the electrolytic vessel 10 is divided into a cathode chamber 4 and an anode chamber 5 by a partition member, for example, a partition wall 3 and the electrochemical cell 1. The electrochemical cell 1 is attached to the partition wall 3. For example, the electrochemical cell 1 is disposed in the electrolytic vessel 10 so that the junction direction of the structural member of the cell coincides with the vertical direction. The anode 11 of the electrochemical cell 1 reaches the anode chamber 5 which occupies the lower portion of the electrolytic vessel 10, and the cathode 31 reaches the cathode chamber 4 which occupies the upper portion of the electrolytic vessel 10.

The electrochemical device 2 comprises, for example, a DC power source 6 configured as a voltage applying unit, a voltmeter 7 as a voltage detector, an ammeter 8 as a current detection unit, and a controller 9.

The both poles of the power source 6 are electrically connected to the anode 11 and the cathode 31, respectively. The power source 6 is configured to apply voltage to the electrochemical cell 1 according to control by the controller 9. The voltmeter 7 is electrically connected to the anode 11 and the cathode 31 to detect the cell voltage of the electrochemical cell 1. The detection information is supplied to the controller 9. The ammeter 8 is intercalated in the voltage application circuit for the electrochemical cell 1, and is configured to detect the cell current which flows through the electrochemical cell 1. The detection information is supplied to the controller 9. The controller 9 controls the application of voltage or a load to the electrochemical cell 1 by the power source 6 according to the detection information according to the program stored in a memory of the controller.

Note that when the electrochemical cell 1 is used for a cell reaction, voltage is loaded on the cell. When the electrochemical cell 1 is used for reactions other than the cell reaction, for example, an oxygen reduction reaction or the like, voltage is applied to the cell. Note that the embodiment is used as the electrochemical device 2 for carrying out the cell reaction, the power source 6 is omitted.

The electrochemical equipment 2 applies or loads voltage between the anode 11 and the cathode 31 while the material subjected to reaction is present in the cathode chamber 4 and the anode chamber 5 to advance the electrochemical reaction for an electrolysis or the electrochemical reaction for a cell reaction.

The anode 11 of the electrochemical cell 1 of the above-described structure is formed with an integrated solid conductive plate, and therefore the anode 11 functions both as an electrode and a collector (or feeder). With this structure, it is not necessary to provide a collector for the anode 11, and thus the number of structural components of the electrochemical cell 1 can be reduced.

Further, unlike the case where a collector is provided for the anode 11, it is not necessary here to carry out special processing for imparting the resistance to corrosion, which may be caused by reaction potential. Therefore, the structure of the electrochemical cell 1 can be simplified and the corrosion of the interface between the collector and the anode does not occur.

The electrochemical reaction in the electrochemical cell 1 occurs at the interface between the electrolytic membrane 35 and the first surface 12 of the anode 11. In this case, an interface with the part equivalent to the collector does not exist in the anode 11 of the solid construction which also functions as the collector. With this structure, despite that electrolytic ions enter the anode 11, the ions do not diffuse, and therefore the corrosion of the anode 11 caused by the reaction potential does not occur easily.

In the anode 11 of the porous structure, the first pores 14 opened in the first surface 12 which contacts the electrolytic membrane 35 are smaller than the second pores 15 opened in the second surface 13, and further the concentration in the first surface 12 is higher than that of pores in the second surface 13. Therefore, the rate of reaction at the interface with the electrolytic membrane 35 can be improved.

Since the anode 11 functions also as the collector, its entire thickness T1 is greater as compared with the thickness T2 of the portion where the first pores 14 are formed. With this structure, the collector resistance of the anode 11 decreases and thus the feeding performance can be improved. Further, in this embodiment, since the thickness T3 of the portion on the second surface 13 side of the anode 11, where the second pores 15 are formed is greater than the thickness T2 of the portion on the first surface 12 side of the anode 11, where the first pores 14 are formed, the feeding performance can be further improved.

The second pores 15 of the anode 11 are formed to narrow toward the first pores 14 which communicate therewith, and widen toward the second surface 13 side. With this structure, products, for example, water, generated by the reaction at the anode 11 are allowed to flow smoothly out from the second pores 15, and therefore it is possible suppress the deactivation of the reaction due to retention of the above-described products in the anode 11.

EXAMPLE 1

The electrochemical cell 1 shown in FIG. 5 and the electrochemical device 2 comprising the electrochemical cell 1 were manufactured, and evaluation of water electrolysis characteristics was performed using the electrochemical device 2. The anode 11 used in Example 1 comprised an electrode base material formed of an integral conductive solid plate as described above.

The cathode 31, which will now be explained, was used in example 1. 5 cc of water and 3 mL of 5-wt % NAFION (registered trademark) solution were mixed with 705 mg of Pt/C (Tanaka Kikinzoku Kogyo, Inc.). This mixture was ultrasonically dispersed for 30 minutes. The thus obtained suspension was sprayed on carbon paper (CETEK, GDL25BC, 0.32 mm in thickness, 235 $cm^2$ in area) subjected to water repel process (20 wt %), followed by drying. The dried carbon paper was cut to have dimensions of 3 cm×4 cm, thus forming the cathode 31.

The anode 11, which will now be explained, was used in example 1. A solution adjusted by adding 1-butanol to iridium chloride (IrCl3.nH2O) to have 0.25M (Ir) was processed at 80° C. for 1 hour in a 10-wt % oxalic acid aqueous solution in advance. The adjusted solution was applied on the first surface 12 of the electrode base material of the anode 11, and then subjected to drying and calcination. In this case, drying was carried out at 80° C. for 10 minutes, and the calcination was carried out at 450° C. for 10 minutes. The above-described series of application, drying and calcination was repeated five times, and the electrode base material was obtained. The obtained base material was cut to have dimensions of 3 cm×4 cm, thus forming the anode 11.

Here, the electrode base material was made of titanium, and had a thickness T1 (FIG. 2) of 0.5 mm. The thickness T2 of the portion including the first pores 14 was 0.15 mm and the thickness T3 of the portion including the second pores 15 was 0.35 mm. Further, the width W (FIG. 1) of a linear portion left when making a mesh in the communicating part between the first pore 14 and the second pore 15 was 0.1 mm, and the width LW (FIG. 1) of a longer side of an opening having a rhombus shape made by the linear portion was 0.57 mm. Further, the width W of a broad linear portion left in the second surface 13 was 1.0 mm, and the width LW was 2.0 mm. The angle θ (see FIG. 1) of the second pores 15 opened into a rhombus shape was 120°. Note that the linear portion is formed to have the width W which satisfies the formula of T1≤W in the relationship with respect to the thickness T1 of the electrode base material.

Next, NAFION (registered trademark) 211 having a thickness of 50 μm, which is the polymer-made electrolytic membrane 35, was interposed from both sides between the anode 11 and the cathode 31 manufactured as above, and subjected to hot pressing at 150° C. and a pressure of 0.36 MPa for three minutes. Thus, the electrochemical cell 1, which is the membrane electrode joint used in example 1, was manufactured.

The electrochemical device 2 of example 1 was driven by applying voltage by the power source 6 between the electrodes of the electrochemical cell 1, that is, between the anode 11 and the cathode 31 while pure water is present in the anode chamber 5 and the cathode chamber 4. Thus, the electrolysis of water occurred, generating oxygen from the anode 11 and hydrogen from the cathode 31.

The reaction formulas involved here are as follows.

Reaction at cathode 31 $H_2 \rightarrow 2H^+ + 2e^-$

Reaction at anode 11 $2H_2O \rightarrow 2O_2 + 4e^- + 4H^+$

Overall reaction $2H_2O \rightarrow 2H_2 + O_2$

The 100-kHz impedance in the electrochemical device 2 of the example 1 was 44.6 mΩ one hour after startup, and the electrolytic voltage required for a cell current of 200 mA/cm$^2$ to flow at that time was 1.94V. The impedance after 50 hours of electrolysis following startup was 47 mΩ, and the electrolytic voltage at that time was 1.94V.

COMPARATIVE EXAMPLE 1

An anode of a porous structure was prepared in the following manner. That is, an electrode base material (of titanium, having a thickness of 0.5 mm, W of 1.0 mm, LW of 2.0 mm and θ of 120°) having a porous diameter in the first surface, a porous diameter in the second surface and a concentration of pores the same as each other and a thickness the same as that of the above-described example 1 was coated with an anode catalyst, iridium oxide as in Example 1. Then, an electrochemical device of Comparative Example 1, which included the above-prepared anode was manufactured and subjected to water electrolysis under the same conditions as those of Example 1.

The 100-kHz impedance in the electrochemical device of Comparative Example 1 was 52 mΩ in one hour after startup, and the electrolytic voltage required for a cell current of 200 mA/cm$^2$ to flow at that time was 2.28V. In contrast, the electrochemical device 2 of the example 1, which includes the electrode base material and the collector formed integrally as the anode 11 had a resistance and electrolytic voltage lower than those of Comparative Example 1, thus clearly proving the superiority of Example 1 to this.

COMPARATIVE EXAMPLE 2

An anode of a porous structure was prepared in the following manner. That is, an electrode base material of titanium (T1 of 0.1 mm, W of 1.0 mm, LW of 0.57 mm and θ of 120°) was coated with iridium oxide as an anode catalyst as in Example 1. Then, to the anode, a titanium-made feed plate (thickness of 0.4 mm, W of 1.0 mm, LW of 2.0 mm and θ of 120°) having a surface not subjected to an anti-corrosion treatment was overlaid, to prepare an anode joint member.

An electrochemical device of Comparative Example 1, which included the above-prepared anode joint member, was manufactured and water electrolysis was carried out using this under the same conditions as those of Example 1.

The 100-kHz impedance in the electrochemical device of Comparative Example 2 was 52 mΩ in one hour after startup, and the electrolytic voltage required for a cell current of 200 mA/cm$^2$ to flow at that time was 1.95V. Further, the impedance after 50 hours of electrolysis from the start was 500 mΩ, and the electrolytic voltage at that time was 3.00V.

The results of Comparative Example 2 indicate that if a titanium plate not subjected to anti-corrosion treatment is used for the feed plate, it is corroded.

In contrast, the electrochemical device 2 of Example 1, which includes the electrode base material and the collector formed integrally as the anode 11 was able to maintain the resistance and electrolytic voltage lower than those of Comparative Example 2 even after 50 hours of electrolysis, thus clearly proving the superiority of Example 1 to this.

COMPARATIVE EXAMPLE 3

An anode of a porous structure was prepared in the following manner. That is, an electrode base material of titanium (T1 of 0.1 mm, W of 1.0 mm, LW of 0.57 mm and θ of 120°) was coated with iridium oxide as an anode catalyst as in Example 1. Then, to the anode, a titanium-made feed plate (thickness of 0.4 mm, W of 1.0 mm, LW of 2.0 mm and θ of 120°) having a surface not subjected to an anti-corrosion treatment was overlaid, followed by spot welding, to prepare an anode joint member. The spot welding was carried out every centimeter on the anode joint member having dimensions of 3 cm×4 cm, and the area of the spot welding was set to 4 mm$^2$. An electrochemical device of Comparative Example 3, which included the above-prepared anode joint member, was manufactured and water electrolysis was carried out using this under the same conditions as those of Example 1.

The 100-kHz impedance in the electrochemical device of Comparative Example 3 was 51 mΩ in one hour after startup, and the electrolytic voltage required for a cell current of 200 mA/cm$^2$ to flow at that time was 1.95V. Further, the impedance after 200 hours of electrolysis from the start was 200 mΩ, and the electrolytic voltage at that time was 2.5V.

The results indicate that an electrochemical device employing an anode joint member prepared by welding an electrode base material coated with iridium oxide and a feed member not coated with iridium exhibits insufficient characteristics. It is considered that such a phenomenon occurs because of the following. That is, the current flow paths are limited to the welded portions, and therefore when the electrochemical device is driven for a long period, corrosion progresses over time in the intermetallic interfaces other than the welded portions. As a result, the absolute quantity of the conductive paths between the electrode base material having a mesh structure and the feed plate becomes short, thereby increasing the impedance.

In contrast, the electrochemical device 2 of Example 1, which includes the electrode base material and the collector formed integrally as the anode 11 was able to maintain the resistance and electrolytic voltage lower than those of Comparative Example 3 even after 200 hours of electrolysis, thus clearly proving the superiority of Example 1 to this.

EXAMPLE 2

As in Example 1, an electrochemical device 2 comprising the electrochemical cell 1 shown in FIG. 5 was manufactured, and brine electrolysis was performed using this. In this case, pure water was put into the cathode chamber 4, and a NaCl aqueous solution, specifically, saturated brine was put into the anode chamber 5. While maintaining this state, voltage is applied by the power source 6 between the electrodes of the electrochemical cell 1, namely, the anode 11 and the cathode 31, to drive the device. Therefore, the electrolysis took place to generate chlorine from the anode 11, and sodium hydroxide from the cathode 31.

The 100-kHz impedance with the electrochemical device 2 of Example 2 was 45 mΩ in one hour after startup, and electrolytic voltage required for a cell current of 200 mA/cm$^2$ to flow at that time was 1.50V. Further, the impedance after 200 hours of electrolysis following startup was 45 mΩ, and the electrolytic voltage at that time was 1.52V.

COMPARATIVE EXAMPLE 4

An anode of a porous structure was prepared in the following manner. That is, an electrode base material (of titanium, having a thickness of 0.5 mm, W of 1.0 mm, LW of 2.0 mm and θ of 120°) having a porous diameter in the first surface, a porous diameter in the second surface and a concentration of pores the same as each other and a thickness the same as that of Example 1 was coated with an anode catalyst, iridium oxide as in Example 1. Then, an electrochemical device of Comparative Example 4, which included the above-prepared anode, was manufactured and brine electrolysis was carried out using this under the same conditions as those of Example 2.

The 100-kHz impedance in the electrochemical device of Comparative Example 4 was 47 mΩ in one hour after startup, and the electrolytic voltage required for a cell current of 200 mA/cm$^2$ to flow at that time was 1.73V.

In contrast, the electrochemical device 2 of the example 1, which includes the electrode base material and the collector formed integrally as the anode 11 had a resistance and electrolytic voltage lower than those of Comparative Example 4, thus clearly proving the superiority of Example 2 to this.

COMPARATIVE EXAMPLE 5

An anode of a porous structure was prepared in the following manner. That is, an electrode base material of titanium (T1 of 0.1 mm, W of 1.0 mm, LW of 0.57 mm and θ of 120°) was coated with iridium oxide as an anode catalyst as in Example 1. Then, to the anode, a titanium-made feed plate (thickness of 0.4 mm, W of 1.0 mm, LW of 2.0 mm and θ of 120°) having a surface not subjected to an anti-corrosion treatment was overlaid, to prepare an anode joint member. An electrochemical device of Comparative Example 2, which included the above-prepared anode joint member, was manufactured and brine electrolysis was carried out using this under the same conditions as those of Example 2.

The 100-kHz impedance in the electrochemical device of Comparative Example 5 was 45 mΩ in one hour after startup, and the electrolytic voltage required for a cell current of 200 mA/cm$^2$ to flow at that time was 1.51V. Further, the impedance after 200 hours of electrolysis following startup was 450 mΩ, and the electrolytic voltage at that time was 2.80V.

The results indicate that if a titanium plate not subjected to anti-corrosion treatment is used for the feed plate, it is corroded.

In contrast, the electrochemical device 2 of Example 2, which includes the electrode base material and the collector formed integrally as the anode 11 was able to maintain the resistance and electrolytic voltage lower than those of Comparative Example 5 even after 200 hours of electrolysis, thus clearly proving the superiority of Example 2 to this.

COMPARATIVE EXAMPLE 6

An anode of a porous structure was prepared in the following manner. That is, an electrode base material of titanium (T1 of 0.1 mm, W of 1.0 mm, LW of 0.57 mm and θ of 120°) was coated with iridium oxide as an anode catalyst as in Example 1. Then, to the anode, a titanium-made feed plate (thickness of 0.4 mm, W of 1.0 mm, LW of 2.0 mm and θ of 120°) having a surface not subjected to an anti-corrosion treatment was overlaid, followed by spot welding, to prepare an anode joint member. The spot welding was carried out every centimeter on the anode joint member having dimensions of 3 cm×4 cm, and the area of the spot welding was set to 4 mm$^2$. An electrochemical device of Comparative Example 6, which included the above-prepared anode joint member, was manufactured and brine electrolysis was carried out using this under the same conditions as those of Example 1.

The 100-kHz impedance in the electrochemical device of Comparative Example 6 was 46 mΩ in one hour after startup, and the electrolytic voltage required for a cell current of 200 mA/cm$^2$ to flow at that time was 1.50V. Further, the impedance after 200 hours of electrolysis following startup was 190 mΩ, and the electrolytic voltage at that time was 2.0V.

The results indicate that an electrochemical device employing an anode joint member prepared by welding an electrode base material coated with iridium oxide and a feed member not coated with iridium exhibits insufficient characteristics. It is considered that such a phenomenon occurs because of the following. That is, the current flow paths are limited to the welded portions, and therefore when the electrochemical device is driven for a long period, corrosion progresses over time in the intermetallic interfaces other than the welded portions. As a result, the absolute quantity of the conductive paths between the electrode base material having a mesh structure and the feed plate becomes short, thereby increasing the impedance.

In contrast, the electrochemical device 2 of Example 2, which includes the electrode base material and the collector formed integrally as the anode 11 was able to maintain the resistance and electrolytic voltage lower than those of Comparative Example 6 even after 200 hours of electrolysis, thus clearly proving the superiority of Example 3 to this.

(Second Embodiment)

The second embodiment describes an electrochemical device comprising the electrochemical cell 1 described in the first embodiment, used as an oxygen reduction device, an oxygen concentration device, a humidifier or a dehumidifier. The structural elements same as those of the first embodiment will be designated by the same reference symbols and the explanations thereof will be omitted.

Figure 6:
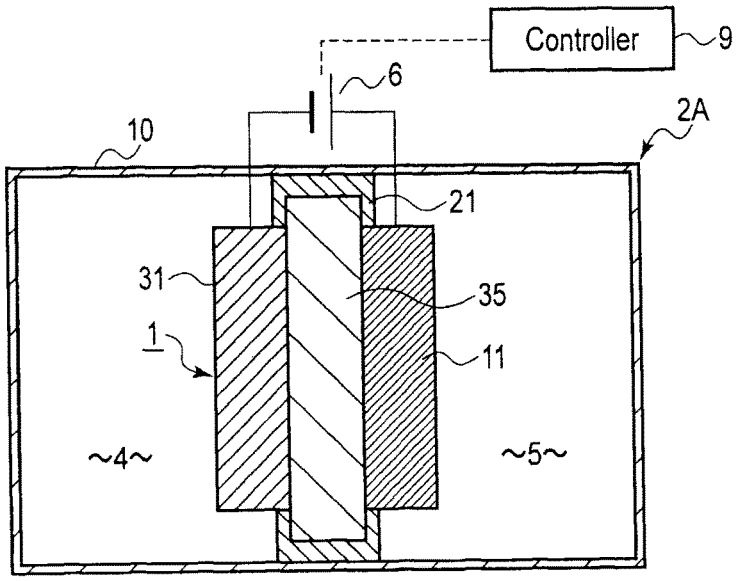
FIG. 6 is a sectional view schematically showing an example of the oxygen reduction device according to a second embodiment.

A first electrochemical device 2A briefly illustrated in FIG. 6 comprises, for example, an electrochemical cell 1, an electrolytic vessel 10, a partition member such as a sealing member 21, a voltage applying unit such as a direct-current power source 6 and a controller 9.

The electrochemical cell 1 is disposed in the electrolytic vessel 10 so that the joint direction of the members of the cell intersects perpendicularly with the vertical direction, and supported by the electrolytic vessel 10 via the sealing member 21. The electrolytic vessel 10 is divided into the cathode chamber 4 and the anode chamber 5 with the electrochemical cell 1 and the sealing member 21. The anode 11 of the electrochemical cell 1 is located in the anode chamber 5, and the cathode 31 is located in the cathode chamber 4.

The two poles of the power source 6 are electrically connected to the anode 11 and the cathode 31. The power source 6 applies voltage to the electrochemical cell 1 under the control of the controller 9.

The controller 9 controls the application of voltage to the electrochemical cell 1 by the power source 6 according to the program stored in a memory provided therein. In the first electrochemical device 2A, the electrochemical cell 1 may be supported in a semi-fixed state so as to be removable with respect to the electrolytic vessel 10.

Figure 7:
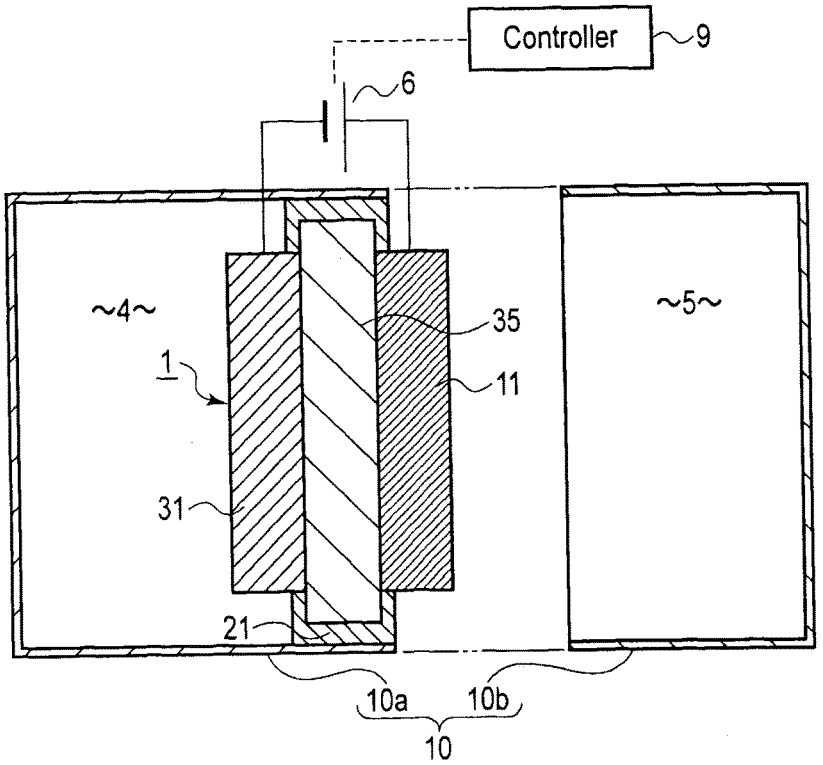
FIG. 7 is a sectional view schematically showing another example of the oxygen reduction device according to the second embodiment.

The electrolytic vessel 10 accommodated in the second electrochemical device 2B schematically shown in FIG. 7 comprises a first container member 10*a* that partitions the cathode chamber 4 and a second container member 10*b* that partitions the anode chamber 5. The first container member 10*a* and the second container member 10*b* are connected so as to be removable.

The electrochemical cell 1 is supported by one of the first container member 10*a* and the second container member 10*b*, for example, the first container member 10*a* through the sealing member 21. In this case, the electrochemical cell 1 may be supported in a semi-fixed state so as to be removable with respect to the container member on which the member is mounted. The rest of the structure other than those described above is the same as that of the first electrochemical device 2A shown in FIG. 6.

The first electrochemical device 2A with the aforementioned structure and the second electrochemical device 2B are operated using an acidic electrolytic membrane 35 in the state where water is supplied to the anode chamber 5 and air is supplied to the cathode chamber 4. By this operation, a reaction which electrolyses water into oxygen and protons takes place in the anodes 11 of the first electrochemical device 2A and the second electrochemical device 2B. Therefore, the first electrochemical device 2A and the second electrochemical device 2B function as an oxygen concentration unit or a dehumidifier.

Here, the reactions taking place in the anode 11 and the cathode 31 are as follows.

Reaction at cathode 31 $2O_2+4e^-+4H^+\rightarrow 2H_2O$

Reaction at anode 11 $2H_2O\rightarrow 2O_2+4e^-+4H^+$

On the other hand, in the cathodes 31 of the first electrochemical device 2A and the second electrochemical device 2B, comprising an electrolytic cell (electrochemical cell 1) which uses the acidic electrolytic membranes 35, oxygen supplied to the cathode chamber 4 and the protons produced with the anodes 11 and transmitting the electrolytic membrane 35 to the cathode 31 by ionic conduction react with each other to produce water.

Thus, the first electrochemical device 2A and the second electrochemical device 2B function as oxygen reduction device or humidifiers.

When the first electrochemical device 2A and the second electrochemical device 2B use neutral or basic electrolytic membranes 35, such reactions take place, in which water is consumed with the anode 11, and water is produced with the cathode 31.

That is, the functions are reversed to the case where the acidic electrolytic membranes 35 were employed. The reactions at the anode 11 and the cathode 31 here are as follows.

Reaction at cathode 31 $O_2+2H_2O+4e^-\rightarrow 4OH^-$

Reaction at anode 11 $4OH^-\rightarrow O_2+2H_2O+4e^-$

Therefore, when the embodiments of the first electrochemical device 2A and the second electrochemical device 2B are carried out as humidifiers configured to add humidity or dehumidifiers configured to reduce humidity, it suffices only if the electrolytic vessel 10 is used as a water supply container or a water-storage container according to the purpose.

Figure 8:
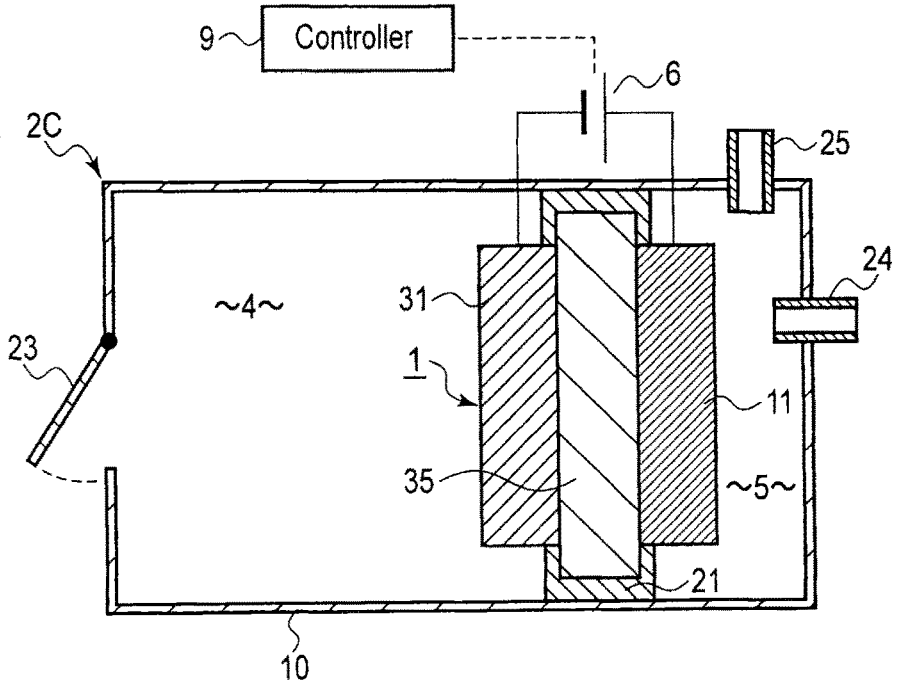
FIG. 8 is a sectional view schematically showing still another example of the oxygen reduction device according to the second embodiment.

A third electrochemical device 2C schematically shown in FIG. 8 is an example as an oxygen reduction device configured to obtain an oxygen concentration lower than that in air. The third electrochemical device 2C comprises an electrochemical cell 1 used as an oxygen reduction cell, an electrolytic vessel 10 used as an oxygen reduction vessel, a partition member such as a sealing member 21, a voltage applying unit such as a direct-current power source 6 and a controller 9.

The electrochemical cell (oxygen reduction cell) 1 is disposed in the electrolytic vessel 10 so that the joint direction of the members of the cell intersects perpendicularly with the vertical direction, and supported by the electrolytic vessel 10 via the sealing member 21. The electrolytic vessel 10 is divided into the cathode chamber 4 and the anode chamber 5 with the electrochemical cell 1 and the sealing member 21. The anode 11 of the electrochemical cell 1 is located in the anode chamber 5, and the cathode 31 is located in the cathode chamber 4.

The two poles of the power source 6 are electrically connected to the anode 11 and the cathode 31. The power source 6 applies voltage to the electrochemical cell 1 under the control of the controller 9. The controller 9 controls the application of voltage to the electrochemical cell 1 by the power source 6 according to the program stored in a memory provided therein. In the third electrochemical device 2C, the electrochemical cell 1 may be supported in a semi-fixed state so as to be removable with respect to the electrolytic vessel 10.

For the third electrochemical device (oxygen reduction device) 2C, an acidic electrolytic membrane 35 is used. The cathode chamber 4 of the third electrochemical device 2C is used as an oxygen reduction chamber. The electrolytic vessel 10 comprises a door 23. The door 23 is opened and closed when loading or unloading an article to be placed under oxygen reduced atmosphere, such as food, in or from the cathode chamber 4. The anode chamber 5 of the third electrochemical device 2C is used as a water tank.

The electrolytic vessel 10 comprises a feed pipe 24 and a discharge pipe 25. The feed pipe 24 is mounted to allow the inside and outside of the anode chamber 5 communicate, thus supplying water to the anode chamber 5. The discharge pipe 25 is mounted on an upper part of the electrolytic vessel 10 to allow the inside and outside of the anode chamber 5 to communicate, discharging the oxygen produced with the anode 11 outside the anode chamber 5.

In the third electrochemical device 2C, the electrolytic vessel 10 may be provided with a member configured to load and unload articles such as a door, or with members to supply and discharge gases, liquids and materials, such as an inlet pipe, an outlet pipe, a liquid feeding pipe and a discharge pipe. Here, doors and pipes of arbitrary shape and function may be selected according to the purpose and use of the device.

The third electrochemical device 2C may be configured to perform oxygen reduction, oxygen concentration, dehumidification or humidification by switching air intake and exhaust, water feeding and discharging and closing regions by the controller 9. At the same time, an oxygen analyzer and/or a hygrometer may be provided thus enabling to easily check the effect by operation of the third electrochemical device (oxygen reduction device). Furthermore, these instruments may be used to control the device to have an arbitrary oxygen concentration or humidity. These controlling operations may be performed electronically by the controller 9 using a microcomputer or programmable IC such as FPGA, or manually.

EXAMPLE 3

A third electrochemical device (oxygen reduction device) 2C shown in FIG. 8, which comprises an electrochemical cell 1 as in Examples 1 and 2, was manufactured.

In Example 3, a cathode 31 was used, which will now be descried. That is, 3 ml of a 5-wt % NAFION (registered trademark) solution and 5 cc of water were mixed with 705 mg of Pt/C (Tanaka Kikinzoku Kogyo, Inc.). The mixture was subjected to ultrasonic for dispersion for 30 minutes. The suspension thus obtained was sprayed on carbon paper (CETEK, GDL25BC, 0.32 mm in thickness, 235 $cm^2$ in area) subjected to water repel process (20 wt %), followed by drying. The dried carbon paper was cut to have dimensions of 3 cm×4 cm, thus forming the cathode 31.

Further, in example 3, the anode 11 was used, which will now be described. A solution adjusted by adding 1-butanol to iridium chloride (IrCl3.nH2O) to have 0.25M (Ir) was processed at 80° C. for 1 hour in a 10-wt % oxalic acid aqueous solution in advance. The adjusted solution was applied on the first surface 12 of the electrode base material of the anode 11, and then subjected to drying and calcination. In this case, drying was carried out at 80° C. for 10 minutes, and the calcination was carried out at 450° C. for 10 minutes. The above-described series of application, drying and calcination was repeated five times, and the electrode base material was obtained. The obtained base material was cut to have dimensions of 3 cm×4 cm, thus forming the anode 11.

Here, the electrode base material was made of titanium, and had a thickness T1 (FIG. 2) of 0.5 mm. The thickness T2 of the portion including the first pores 14 was 0.15 mm and the thickness T3 of the portion including the second pores 15 was 0.35 mm. Further, the width W (FIG. 1) of a linear portion left when making a mesh in the communicating part between the first pore 14 and the second pore 15 was 0.1 mm, and the width LW (FIG. 1) of a longer side of an opening having a rhombus shape made by the linear portion was 0.57 mm. Further, the width W of a broad linear portion left in the second surface 13 was 1.0 mm, and the width LW was 2.0 mm. The angle θ (see FIG. 1) of the second pores 15 opened into a rhombus shape was 120°. Note that the linear portion is formed to have the width W which satisfies the formula of T1≤W in the relationship with respect to the thickness T1 of the electrode base material.

Next, NAFION (registered trademark) 211 having a thickness of 50 μm, which is the polymer-made electrolytic membrane 35, was interposed from both sides between the anode 11 and the cathode 31 manufactured as above, and subjected to hot pressing at 150° C. and a pressure of 0.36 MPa for three minutes. Thus, the electrochemical cell (oxygen reduction cell) 1, which is the membrane electrode joint member, was manufactured.

The electrochemical device 2C of Example 3 was driven by applying voltage by the power source 6 between the electrodes of the electrochemical cell 1, that is, between the anode 11 and the cathode 31 while pure water is put in the anode chamber 5 and air is supplied into the cathode chamber 4. Thus, the electrolysis of water occurred, in which water was consumed in the reaction with the anode 11, thus producing oxygen, whereas oxygen was consumed in the reaction with the cathode 31, thus producing water.

The 100-kHz impedance in the electrochemical device 2C of Example 3 was 44.6 mΩ in one hour after startup, and the electrolytic voltage required for a cell current of 200 $mA/cm^2$ to flow at that time was 1.13V.

COMPARATIVE EXAMPLE 7

An anode of a porous structure was prepared in the following manner. That is, an electrode base material (of titanium, having a thickness of 0.5 mm, W of 1.0 mm, LW of 2.0 mm and θ of 120°) having a porous diameter in the first surface, a porous diameter in the second surface and a concentration of pores the same as each other and a thickness the same as that of Example 3 was coated with an anode catalyst, iridium oxide as in Example 1. Then, an electrochemical device of Comparative Example 7, which included the above-prepared anode, was manufactured and electrolysis (oxygen reduction) was carried out using this under the same conditions as those of Example 3.

The 100-kHz impedance in the electrochemical device of Comparative Example 7 was 52 mΩ in one hour after startup, and the electrolytic voltage required for a cell current of 200 $mA/cm^2$ to flow at that time was 1.57V.

In contrast, the electrochemical device 2 of Example 1, which includes the electrode base material and the collector formed integrally as the anode 11 had a resistance and an electrolytic voltage lower than those of Comparative Example 4, thus clearly proving the superiority of Example 3 to this.

EXAMPLE 4

A third electrochemical device (oxygen reduction device) 2C shown in FIG. 8, which comprised an electrochemical cell 1 as in Examples 1 and 2, was manufactured. In this case, the anode 11 and the cathode 31 used in the electrochemical cell 1 where those produced under the same conditions as those of Example 3. The electrochemical device 2C was driven by applying voltage by the power source 6 between the electrodes of the electrochemical cell 1, that is, between the anode 11 and the cathode 31 while humidified air was supplied to the anode chamber 5 and dry air was supplied into the cathode chamber 4.

In this manner, electrolysis occurred, in which humidity in the air was consumed in the reaction with the anode 11, thus producing oxygen, whereas oxygen was consumed in the reaction with the cathode 31, thus producing water.

Here, it was confirmed that the humidity of the air flowing out of the anode chamber 5 was reduced as compared to the humidified air supplied to the anode chamber 5. More specifically, when a supply air having a temperature of 25° C. and a saturated humidity of 300 CCM was fed to the feed pipe 24 of the anode chamber 5 with, the humidity of the air discharged to the outside of the anode chamber 5 through the discharge pipe 25 reduced to 51% at an electrolytic voltage of 50 mA per square centimeter.

The 100-kHz impedance in the electrochemical device (oxygen reduction device) 2C shown in FIG. 8 was 45 mΩ in one hour after startup, and the electrolytic voltage required for a cell current of 50 $mA/cm^2$ to flow at that time was 1.3V.

COMPARATIVE EXAMPLE 8

An anode of a porous structure was prepared in the following manner. That is, an electrode base material (of titanium, having a thickness of 0.5 mm, W of 1.0 mm, LW of 2.0 mm and A of 120°) having a porous diameter in the first surface, a porous diameter in the second surface and a concentration of pores the same as each other and a thickness the same as that of Example 3 was coated with an anode catalyst, iridium oxide as in Example 1. Then, an electrochemical device of Comparative Example 8, which included the above-prepared anode, was manufactured and electrolysis (oxygen reduction) was carried out using this under the same conditions as those of Example 4.

The 100-kHz impedance in the electrochemical device of Comparative Example 8 was 46 mΩ in one hour after startup, and the electrolytic voltage required for a cell current of 50 mA/cm$^2$ to flow at that time was 2.3V.

In contrast, the electrochemical device 2 of Example 1, which includes the electrode base material and the collector formed integrally as the anode 11 had a resistance and an electrolytic voltage lower than those of Comparative Example 8, thus clearly proving the superiority of Example 4 to this.

EXAMPLE 5

A third electrochemical device (oxygen reduction device) 2C described in Example 3, was manufactured except that the cathode 31 used in the electrochemical device 2C was of an integral structure similar to that of the anode 11.

That is, the cathode 31 was manufactured to have a porous structure wherein the two surfaces have different concentrations, by processing a pure Pt plate (having a thickness T1 of 0.5 mm) by etching, which was then cut to dimensions of 3 cm×4 cm. By the etching, the cathode 31 had a thickness T2 of 0.35 mm and a thickness T1 of 0.15 mm. Further, the structure of the cathode 31 was the same as that shown in FIG. 1, which was described in connection with the anode 11. The configuration of the first surface of the cathode 31 processed by the etching had a W of 1.0, LW of 2.0 mm and θ of 120°.

The configuration of the second surface of the cathode 31 processed by etching similarly had a W of 0.1 mm, LW of 0.57 mm and A of 120°.

The anode 11 was produced as follows. That is, a solution adjusted by adding 1-butanol to iridium chloride ($IrCl_3.nH_2O$) to have 0.25M (Ir) was processed at 80° C. for 1 hour in a 10-wt % oxalic acid aqueous solution in advance. The adjusted solution was applied on the first surface 12 of the electrode base material of the anode 11, and then subjected to drying and calcination. In this case, the drying was carried out at 80° C. for 10 minutes, and the calcination was carried out at 450° C. for 10 minutes. The above-described series of application, drying and calcination was repeated five times, and the electrode base material was obtained. The obtained base material was cut to have dimensions of 3 cm×4 cm, thus forming the anode 11.

Here, the electrode base material was made of titanium, and had a thickness T1 (FIG. 2) of 0.5 mm. The thickness T2 of the portion including the first pores 14 was 0.15 mm and the thickness T3 of the portion including the second pores 15 was 0.35 mm. Further, the width W (FIG. 1) of a linear portion left when making a mesh in the communicating part between the first pore 14 and the second pore 15 was 0.1 mm, and the width LW (FIG. 1) of a longer side of an opening having a rhombus shape made by the linear portion was 0.57 mm. Further, the width W of a broad linear portion left in the second surface 13 was 1.0 mm, and the width LW was 2.0 mm. The angle θ (FIG. 1) of the second pores 15 opened into a rhombus shape was 120°. Note that the linear portion is formed to have the width W which satisfies the formula of T1≤W in the relationship with respect to the thickness T1 of the electrode base material.

Next, NAFION (registered trademark) 211 having a thickness of 50 μm, which is the polymer-made electrolytic membrane 35, was interposed from both sides between the anode 11 and the cathode 31 manufactured as above, and subjected to hot pressing at 150° C. and a pressure of 0.36 MPa for three minutes. Thus, the electrochemical cell 1, which is the membrane electrode joint member, was manufactured.

The electrochemical device 2C (oxygen reduction device) of Example 5, which used the electrochemical cell 1 thus obtained as an oxygen reduction cell, was driven. More specifically, the oxygen reduction device was driven by applying voltage by the power source 6 between the electrodes of the electrochemical cell 1, that is, between the anode 11 and the cathode 31 while pure water was supplied in the anode chamber 5 and air was supplied into the cathode chamber 4. Thus, electrolysis occurred, in which water was consumed in the reaction with the anode 11, thus producing oxygen, whereas oxygen was consumed in the reaction with the cathode 31, thus producing water.

The 100-kHz impedance in the electrochemical device (oxygen reduction device) of Example 5 was 40 mΩ in one hour after startup, and the electrolytic voltage required for a cell current of 200 mA/cm$^2$ to flow at that time was 1.2V.

(Third Embodiment)

Figure 9:
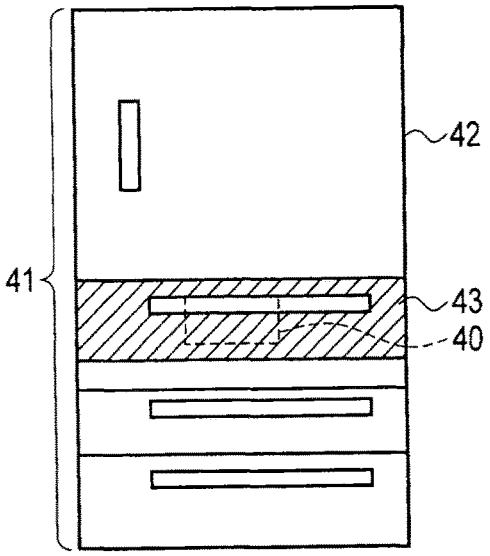
FIG. 9 is a diagram schematically showing a refrigerator according to a third embodiment.

FIG. 9 is a conceptual diagram showing a refrigerator 41 comprising an oxygen reduction device 40. As shown in FIG. 9, the refrigerator 41 comprises a main body 42, which includes the oxygen reduction device 40. Note that in FIG. 9, the oxygen reduction device 40 is indicated by parallel slash lines, to be easily distinguishable from the other refrigeration chambers or freezer compartment.

A refrigerant is circulated in the wall (not shown) which partitioned the oxygen reduction chamber 43 configured as a preservation space. With this structure, subjects to be preserved, such as vegetables put in and out of the oxygen reduction chamber 43 can be preserved at low temperature. In order to easily put in and out subjects to be preserved, the oxygen reduction chamber 43 is opened in a front portion of the main body 42 of the refrigerator. The opening can be closed with an open/close member and the oxygen reduction chamber 43 is maintained at a sealed state while the open/close member is shut.

The open/close member configured to open/close the oxygen reduction chamber 43 may be a heat-insulating door pivotally attached to the main body 42 of the refrigerator, or a heat insulating lid of a drawer to be moved back and forth through the front opening of the oxygen reduction chamber 43, which also functions a front wall of the drawer.

For the oxygen reduction device 40 comprising the refrigerator 41, an oxygen reduction device comprising an electrochemical cell as an oxygen reduction cell, for example, the oxygen reduction device shown in FIG. 8 can be used. In this case, the oxygen reduction device 40 is disposed so that that cathode 31 (FIG. 8) is able to react with oxygen in the oxygen reduction chamber 43, and also water having passed through the water supply unit (not shown) is supplied to the anode 11 (see FIG. 8).

In the case of the refrigerator 41 comprising the electrochemical device shown in FIG. 8 as the oxygen reduction device 40, the door 23 shown in FIG. 8 may be used as the open/close door of the refrigerator 41.

In the refrigerator 41 of FIG. 9, the oxygen reduction chamber 43 is realized as one compartment of the main body 42 of the refrigerator is, it may be realized as a part of one compartment of the main body 42 of the refrigerator. The oxygen reduction device 40 may be located anywhere in the main body 42 of the refrigerator.

By performing oxygen reduction in a storage where perishable foods are preserved, oxidation of food can be suppressed. Further, in the refrigerator 41, a humidifier or dehumidifier device comprising an electrochemical cell as an electrolytic cell may be employed instead of the oxygen reduction device 40 using the electrochemical cell as an oxygen reduction cell.

In FIG. 9, instead of the oxygen reduction device 40, equipment configured to control select one of oxygen reduction, dehumidification and humidification by switching air intake and exhaust, water feeding and discharging and closing regions by a controller (not shown) may be provided. An oxygen analyzer and/or a hygrometer may be provided in the main body 42 of the refrigerator to be also to easily check the effect by the oxygen reduction of the oxygen reduction device 40, or to be controlled to an arbitrary oxygen concentration or humidity. These controlling operations may be realized by electronic control using a microcomputer or programmable IC such as FPGA, or manually.

EXAMPLE 6

The oxygen reduction device 40 of the refrigerator 41 shown in FIG. 9 was driven to operate oxygen reduction by applying voltage between the anode 11 and cathode 31. The oxygen reduction device 40 was driven in this way, and it was confirmed that the oxygen concentration in the oxygen reduction chamber 43 decreased according to the current which flows through the oxygen reduction cell within predetermined time as theoretically expected, in more detail, the concentration decreased from about 21% to about 10%.

In the refrigerator 41, as the door 23 (FIG. 8) is closed, the oxygen reduction device 40 is driven in a state where the door 23 is shut. Then, the oxygen concentration in the oxygen reduction chamber (that is, the cathode chamber) 43 in which food, etc., is stored is decreased. Thus, the degradation of the food due to oxidation can be suppressed and the preservation period of food can be extended.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Further, note that some of the elements described in the above-provided descriptions are expressed by the chemical symbols for the elements.

What is claimed is:

1. An electrochemical cell comprising:

an anode;

a cathode; and an electrolytic membrane interposed therebetween;

at least one of the anode and the cathode comprising a solid conductive metal plate, and including a first surface in contact with the electrolytic membrane and a second surface apart from the first surface in a thickness direction, the at least one of the anode and the cathode including a plurality of first pores opened in the first surface and a plurality of second pores opened in the second surface, the second pores communicating with only a part of the first pores, and the first pores being smaller than the second pores, the concentration of pores in the first surface being higher than the concentration of pores in the second surface, wherein the number of the plurality of first pores is 30 per square centimeter or more.

2. The electrochemical cell of claim 1, wherein the at least one of the anode and the cathode comprises a region on the second surface side in which the plurality of second pores are formed, having a thickness greater than a region on the first surface in which the plurality of first pores are formed.

3. The electrochemical cell of claim 2, wherein the number of the plurality of first pores is 200 per square centimeter or more.

4. The electrochemical cell of claim 2, wherein the plurality of second pores are formed so that the second pores narrow further toward the first pores side with which the second pores communicate, and widen toward the second surface side.

5. The electrochemical cell of claim 4, wherein the first surface in which the plurality of first pores are formed is coated with a catalytic layer.

6. The electrochemical cell of claim 1, wherein the number of the plurality of first pores is 200 per square centimeter or more.

7. The electrochemical cell of claim 1, wherein the plurality of second pores are formed so that the second pores narrow further toward the first pores side with which the second pores communicate, and widen toward the second surface side.

8. The electrochemical cell of claim 1, wherein the first surface in which the plurality of first pores are formed is coated with a catalytic layer.

9. An electrochemical device comprising:

trolytic vessel provided with the electrochemical cell of claim 1;

a power source configured to apply voltage to the electrochemical cell; and a controller configured to control a voltage application to the electrochemical cell.

10. The electrochemical device of claim 9, wherein the electrolytic vessel comprises an anode chamber facing the anode of electrochemical cell, and a cathode chamber facings the cathode of the electrochemical cell.

11. The electrochemical device of claim 9, wherein the electrochemical device is configured for brine electrolysis.

* * * * *